US006712461B2

(12) United States Patent
Haan et al.

(10) Patent No.: US 6,712,461 B2
(45) Date of Patent: Mar. 30, 2004

(54) INK JET PRINTING SYSTEM, INK CONTAINER AND METHOD OF PREPARING THE SAME

(75) Inventors: Maurice Johan Jozef Haan, Heerlen (NL); Johannes Koning, Kronenberg (NL); Hans Wierink, Maasbree (NL)

(73) Assignee: OCE -Technologies B.V., Ma Venlo (NL)

( * ) Notice: Subject to any disclaimer, the term of this patent is extended or adjusted under 35 U.S.C. 154(b) by 0 days.

(21) Appl. No.: 09/991,952

(22) Filed: Nov. 26, 2001

(65) Prior Publication Data

US 2002/0063762 A1 May 30, 2002

(30) Foreign Application Priority Data

Nov. 27, 2000 (EP) ..... 00204200

(51) Int. Cl.[7] ..... B41J 2/175; B41J 29/38
(52) U.S. Cl. ..... 347/88; 347/17
(58) Field of Search ..... 347/88, 17, 18, 347/19, 85, 86, 87

(56) References Cited

U.S. PATENT DOCUMENTS

| | | | | |
|---|---|---|---|---|
| 5,049,898 A | | 9/1991 | Arthur et al. | 347/19 |
| 5,168,284 A | | 12/1992 | Yeung | 347/17 |
| 5,486,848 A | * | 1/1996 | Ayata et al. | 347/15 |
| 5,502,467 A | | 3/1996 | Hoisington et al. | 347/6 |
| 5,664,893 A | * | 9/1997 | Meeussen et al. | 400/120.14 |
| 5,689,297 A | | 11/1997 | Yokoyama et al. | 347/188 |
| 5,699,091 A | * | 12/1997 | Bullock et al. | 347/19 |
| 6,019,461 A | | 2/2000 | Yoshimura et al. | 347/86 |
| 6,302,509 B1 | * | 10/2001 | Iwasaki et al. | 347/17 |
| 6,631,967 B1 | * | 10/2003 | Saruta | 347/19 |

FOREIGN PATENT DOCUMENTS

| | | |
|---|---|---|
| DE | A1 3405 164 | 8/1985 |
| EP | A 0 416 557 | 3/1991 |
| EP | A 0 816 085 | 1/1998 |
| EP | A 0 947 326 | 10/1999 |
| JP | A 09 277503 | 10/1997 |

* cited by examiner

*Primary Examiner*—Michael Nghien
(74) *Attorney, Agent, or Firm*—Birch, Stewart, Kolasch & Birch, LLP

(57) ABSTRACT

An ink jet printing system a print head containing nozzles, a replaceable ink container, an ink supply reservoir connecting the ink container to the nozzles of the print head, and a temperature control system for controlling the temperature of the ink in the ink supply reservoir, wherein the parameters T(0); $\Delta T/\Delta t$, which permit a determination of the optimal operating temperature for the ink are physically encoded on the ink container to be read by the temperature control system, T(0) being the optimal operating temperature at time 0 and $\Delta T/\Delta t$ representing the temperature change of the ink over time.

10 Claims, 2 Drawing Sheets

*Fig. 2*
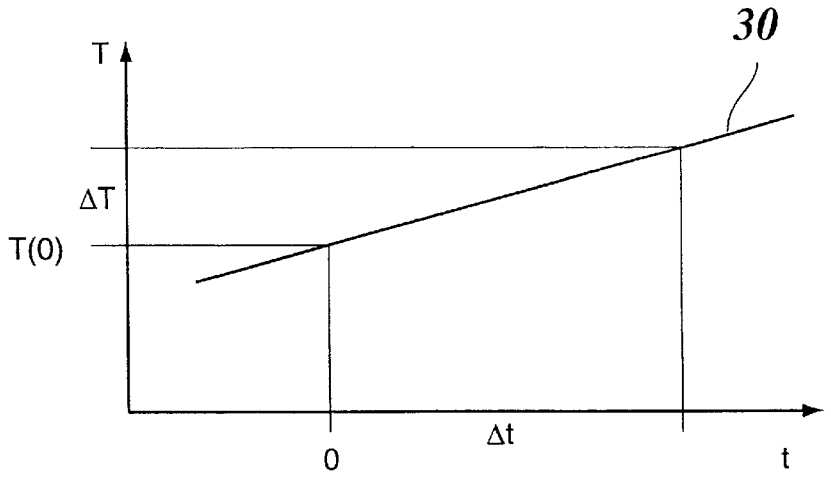
*Fig. 3*
| Ser.-No. | |
|---|---|
| ink colour | |
| ink type | |
| init. ink quantity. | |
| filling date | |
| Printer A | Printer B |
| T(0), ΔT/Δt | T(0), ΔT/Δt |
*Fig. 4*
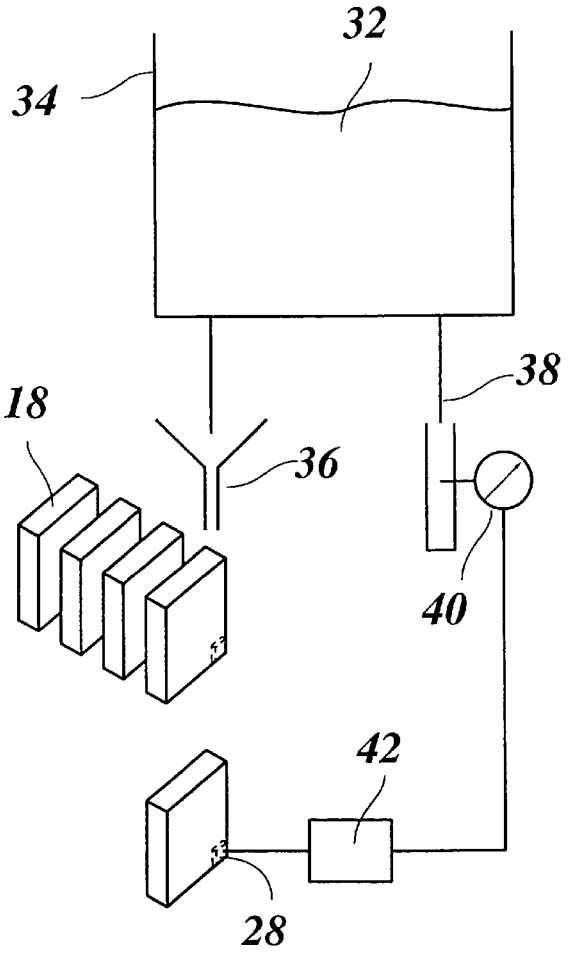

INK JET PRINTING SYSTEM, INK CONTAINER AND METHOD OF PREPARING THE SAME

BACKGROUND OF THE INVENTION

The present invention relates to an ink jet printing system comprising a print head, a replaceable ink container, an ink supply system connecting the ink container to the nozzles of the print head, and a temperature control system controlling the temperature of the ink in the ink supply system. The present invention further relates to an ink container for use in such a printing system and to a method of preparing and filling such an ink container.

It is well known in the art of ink jet printing that the viscosity of the ink being used has a critical impact on the performance of the print head and on the quality of the printed image, mainly because the viscosity of the ink influences the size of the ink droplets that are generated by the print head and are then deposited on the recording medium. Since the viscosity depends on the temperature of the ink, printing systems of the type indicated above are equipped with a temperature control system which controls the operating temperature of the ink and thereby indirectly controls the ink viscosity.

In an ink jet printing system intended for operation at a temperature close to room temperature, the ink may be heated beyond admissible limits by the heat energy dissipated in the print head in the course of droplet generation. In view of this problem, U.S. Pat. No. 5,168,284 discloses a temperature control system in which the print head is caused to generate non-printing pulses, the energy of which is not sufficient for generating an ink droplet and the only purpose of which is to dissipate to the ink an amount of heat which is comparable to the amount of heat created in a drop generating process. Thus, the equilibrium between heat generation in the print head and heat dissipation to a heat sink can be stabilized regardless of the number of droplets being generated per unit of time. By controlling the number and/or energy of the non-printing pulses, it is then possible to control the temperature of the ink either in an open loop or in a closed loop.

In a hot melt ink jet printer, where the operating temperature of the ink is in the order of 100° C. or more, a temperature control system is generally needed for keeping the ink at the operating temperature. EP-A-0 416 557 discloses a temperature control system which is used for adapting the operating temperature and hence the viscosity of the ink to the type of recording medium being used. The optimal viscosity of the ink is determined beforehand for a number of different types of recording paper. Then, the target temperature of a temperature control system is set to a value at which the viscosity of the ink corresponds to the optimal viscosity for the recording paper that is currently being used. Of course, since the viscosity of the ink depends not only on the temperature but also on the chemical composition of the ink, it is prerequisite in such a system that the chemical composition of the ink is known.

It is a general principle in the art of ink jet printing that a specific print head should only be used with a specific type of ink. If a different type of ink is used which is not adapted to the specific print head, then the deviation of the ink viscosity from the value for which the print head is designed may result in a poor quality of the printed image or even in damage to the print head. It has therefore always been a concern of manufacturers of ink jet printers to make sure that the printers are used only with a specified type of ink. To this end, it has been proposed, for example, in U.S. Pat. No. 5,049,898 and DE-A-34 05 164 that the ink container is provided with a memory element, e.g. a magnetic strip, a bar code or an electronic memory chip, the contents of which can be read when the container is mounted to the print head. The memory element may include among others information on the type of ink contained in the container, and when the type of ink read from the memory element does not match with the type of ink prescribed for the print head, then the printing operation will be blocked. In this case, the memory element may also include information on the amount of ink that is initially or currently contained in the ink container, and by monitoring the consumption of ink in the printer, it is possible to alert the user when the supply of ink in the container is going to be exhausted. This system may also be used to prevent unauthorized refilling of the ink container, thereby assuring that the container will always contain the type of ink that is specified on the memory element.

U.S. Pat. No. 5,502,467 discloses an ink jet print head which includes a viscosity detector with which the viscosity of the ink can be measured directly, and the result of this measurement is then fed back to the temperature control system, so that the temperature of the ink is varied in order to feedback-control the viscosity of the ink to a given target value. However, this system has the drawback that an expensive viscosity detector is needed for measuring the viscosity with sufficient accuracy. In practice, the viscosity detector is formed by a fluidic bridge circuit which only detects the offset of the viscosity from a preset target value. As a result, it would be difficult to vary the ink viscosity in accordance with the properties of the recording medium. In addition, the optimal viscosity of the ink may be different for different types of ink, e.g., for different ink colors in a multi-color printer. Thus, even when the viscosity is measured directly in the print head, it is difficult to keep the viscosity of inks of different type at the optimal value for obtaining high quality printed images.

SUMMARY OF THE INVENTION

It is an object of the present invention to provide an ink jet printing system in which a reliable operation of the print head and a high quality of the printed image can be assured in spite of variations in the composition of the ink that is being used.

According to the present invention, this object is achieved by the feature that information permitting the determination of the optimal operating temperature for the ink is physically encoded on the ink container where it can be read by the temperature control system. The information permitting the determination of the optimal operating temperature may in the simplest case consist of a target value to which the temperature of the ink in the ink supply system shall be controlled. More generally, this information may include a plurality of target values among which a specific target value may be selected in response to other printing parameters, e.g. the type of print head and/or the type of recording medium. In yet another embodiment, this information may include one or more target values for the viscosity of the ink, along with a table or a function establishing a relation between temperature and viscosity for the specific ink contained in the container. The information may further include the time dependency of the optimal target value, e.g. in view of aging of the ink. In any case, when the ink container is inserted in the printer, the temperature control system can derive the target value for the temperature from the information encoded on the container, so that the operating temperature of the ink is optimally adapted to the composition of the ink and, as the case may be, to other printing parameters. This assures a very high print quality even in cases where the composition of the ink being used is not always exactly the same.

Accordingly, it is a remarkable advantage of the present invention that one and the same printer may accept different types of ink, because the viscosity of the ink can automatically be adapted to the demands of the print head by appropriate temperature control. This reduces significantly the expenses for manufacturing, storing, administrating and distributing suitable types of ink containers to a large number of customers using different types of printers.

On the other hand, even when only a specific type of ink is to be used for a given printer, the invention has the advantage that a higher quality of the printed images can be achieved. The reason is that, due to slight variations in the manufacturing conditions, the chemical and physical properties of the ink may vary even when the type of ink is not changed. This is especially the case if ink containers of the same type have been produced in different batches. In this situation, the manufacturer of the ink containers may measure the properties of the ink for each individual batch, and the optimal operating temperature or viscosity of the ink is derived from this measurement and is encoded on the ink containers which are filled with the ink of the pertinent batch. As a result, slight changes in the properties of the ink from batch to batch may be reflected by corresponding changes in the information given on the ink containers.

The physical encoding on the ink container is preferably in the form of a digital electronic memory, e.g. an integrated circuit chip (an EPROM for example) that has been suitably programmed on behalf of the ink manufacturer. As is generally known in the art, this chip may also include other useful information, such as a serial number of the ink container, the date of production, the amount of ink contained in the container, and the like. If desired, this chip may also be used for refill protection, for example by programming the chip to send a disabling signal to the printer once the contents of the container have become exhausted.

The power supply for the chip and the exchange of signals between the chip and the printer may be provided for by a plurality of mating electrical contacts on the ink container and on a socket of the print head to which the container can be fitted. As an alternative, the electronic chip may form part of a transponder which is adapted for wireless power supply and data exchange, as is generally known in the art.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein:

FIG. 2 is a diagram illustrating the time dependency of the ink operating temperature;

FIG. 3 is a table of contents of a memory chip of an ink container; and

FIG. 4 is a diagram illustrating a method of preparing ink containers.

DETAILED DESCRIPTION OF THE INVENTION

Figure 1:
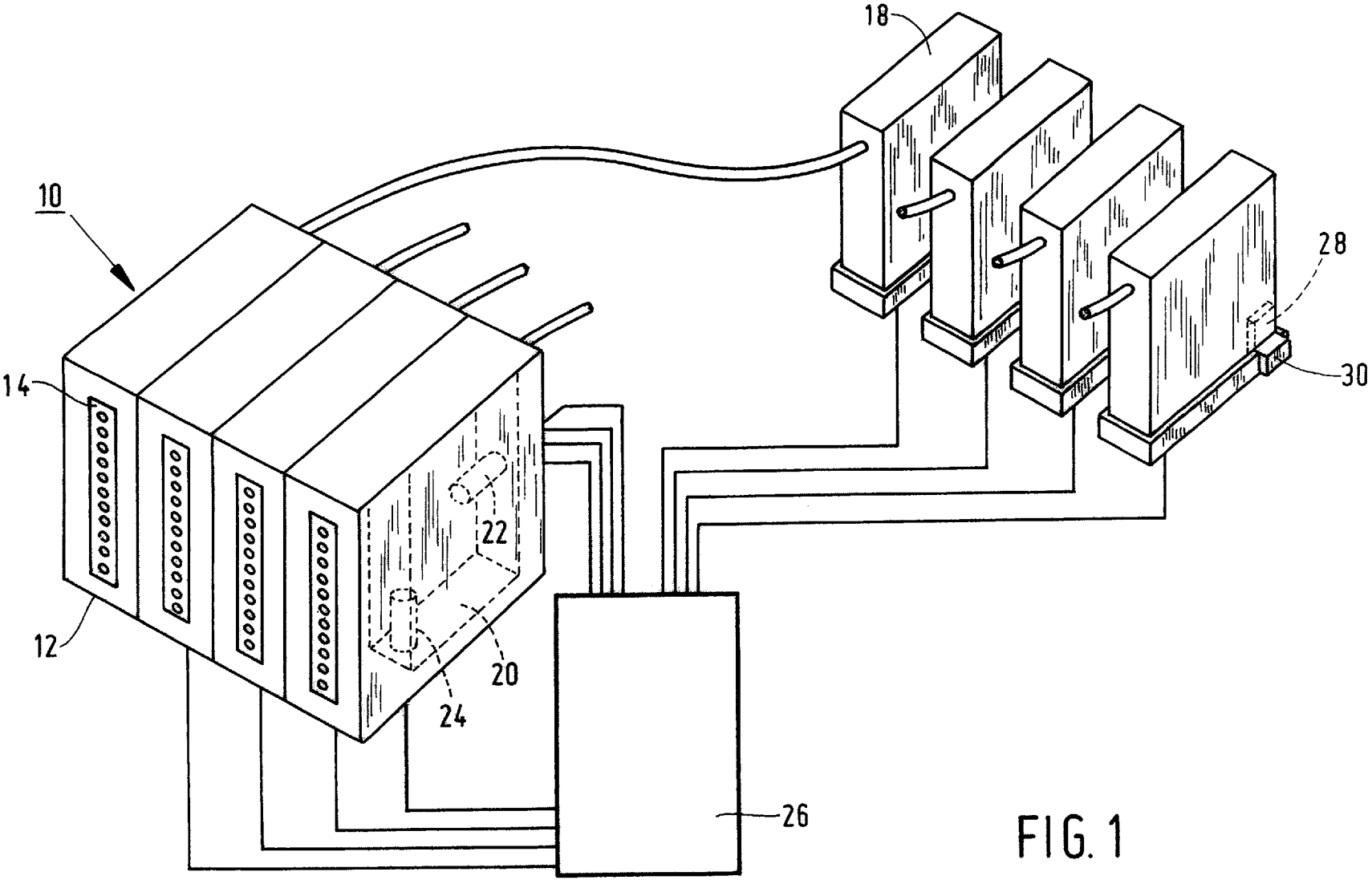
FIG. 1 is a schematic view of a printing system according to the present invention.

The ink jet printing system shown in FIG. 1 comprises a four-color print head 10 having four nozzles blocks 12, one for each color, and each nozzle block has a linear array of nozzles 14 through which ink droplets are jetted-out as the print head 10 scans the surface of a recording medium (not shown). Each nozzle block 12 has a socket (not shown) to which an ink container 18 is fitted or connected via a duct. The ink containers 18 shown in FIG. 1 have relatively small dimensions in comparison to the nozzle blocks 10. It will be understood however that, in practice, the size of the ink containers 18 may be considerably larger, so that the amount of ink originally filled therein may be as large as 350 ml or even 500 ml.

Each of the nozzles blocks 12 has an ink supply system which connects the corresponding ink container 18 to each of the nozzles 14. The ink supply system is represented here as an ink reservoir 20 formed in each nozzle block 12. Each nozzle 14 is connected to the ink reservoir 20 through an ink channel which has not been shown in the drawing for simplicity. An actuating mechanism for drop generation is associated with each of the ink channels, so that each nozzle 14 may be energized individually. The actuating mechanisms may be of any known type, e.g. a bubble-jet mechanism, a piezoelectric mechanism and the like.

Each of the ink reservoirs 20 has a heating element 22 and a temperature sensor 24 which are each electrically connected to a control unit 26 which controls the temperature of the liquid ink contained in the ink reservoir 20. The temperature sensor 24 is located in proximity to the nozzle side of the ink reservoir 20 so as to detect the temperature at which the ink is supplied to the nozzles.

By way of example, it may be assumed that the print head 10 is a hot melt ink print head. Then, the ink containers 18 may contain solid ink pellets which are dropped one-by-one into the ink reservoirs 20 upon demand, and the ink is heated and melted in the ink reservoirs 20 by means of the heating element 22.

It will be understood however that the invention is also applicable to ink systems operating at room temperature. In this case, the ink containers 18 will contain liquid ink. In case the containers are made such that they fit into a socket on the print head the container is scaled by a seal (not shown) which is automatically broken when the container is plugged into the socket, as is well known in the art. If the ink is liquid at room temperature, the heating element 22 is used only to heat the ink to an operating temperature which may be slightly above room temperature. Optionally, the heating element 22 may be replaced by a cooling element or a heating/cooling element such as a Peltier element, so that the operating temperature of the ink may be controlled to a value which is at or even slightly below the ambient temperature.

Each ink container has a memory chip 28, e.g. an integrated circuit semiconductor chip, which, in the example shown, is embedded in the plastic wall of the ink container 18 and has contacts (not shown) exposed to the outside, so that they may be contacted by a reading head 30. Each reading head 30 is connected to the control unit 26.

Each memory chip 28 stores information which is processed in the control unit 26 to determine a target value to which the temperature of the ink in the ink reservoirs 20 is controlled when the print head 10 is operating. In the simplest case, this information may consist just of the target value itself, and this target value is specifically adapted to the type of ink contained in the ink container 18, so that the operating temperature and viscosity of the ink in the ink reservoir 20 is maintained at a value which is optimal for the specific type of ink. Since the four ink containers 18 shown in FIG. 1 accommodate ink of different color, it will be understood that the target values stored in each of the memory chips 28 may be different from one another and may be individually adapted to the type and color of the ink.

A more elaborated embodiment of the invention will now be described in conjunction with FIGS. 2 and 3.

Depending on the ink system employed, the ink may be subject to aging, and, as a result, the optimal operating temperature of the ink may be time-dependent. The graph 30 shown in FIG. 2 illustrates a linear relationship between the optimal operating temperature T of the ink and the time t. When the ink container 18 is filled with fresh ink on the side of the manufacturer at the time t=0, the corresponding optimal operating temperature is T(0). With the lapse of a certain time interval Δt (which may be in the order to several months or years), the optimal operating temperature T increases by an amount ΔT. Thus, the optimal operating temperature (T(t)) at any given time t will be given by the formula:

$$T(t)=T(0)+(\Delta T/\Delta t)\cdot t$$

FIG. 3 illustrates an example of the contents that may be stored in the memory chip 28. These contents comprise a 64 bit serial number and 256 bit of additional information. This additional information includes the color of the ink, the ink type (specifying the chemical composition of the ink), the initial quantity of ink filled into the ink container on the side of the manufacturer, the filling date and the parameters T(0) and ΔT/Δt the meaning of which has been explained above. These parameters are given in the form of a table, for two different types of printers A and B. Thus, provided that the printer A or B has an internal clock or has access to the current date through a network, the control unit 26 is capable of calculating the time-dependent optimal ink temperature T on the basis of the formula given above, wherein t is the time difference between the current date and the filling date stored on the memory chip, and the parameters T(0) and ΔT/Δt are looked-up in the pertinent column of the table.

FIG. 4 illustrates a method for preparing the ink containers 18, i.e., for filling the ink containers with ink and programming the memory chip 28.

In a first step, a batch of ink 32 sufficient for filling a large number of ink containers 18 is prepared in a tank 34. Then, in a filling station 36, the ink 32 is filled into the various containers 18, and the containers are sealed. A small portion of the ink 32 is taken from the tank 34 as a sample 38 and is supplied to a viscosity meter 40. The temperature of the sample 38 in the viscosity meter 40 is varied, so that the viscosity of the ink is measured for a temperature range covering the range of possible operating temperatures of the print heads 10. The measurement results are supplied to a programming unit 42. On the basis of the known optimal viscosity of the ink 32 for the print head 10, the programming unit 42 determines the target temperature T at which the ink 32 has this optimal viscosity. The temperature value T thus obtained is stored in the memory chips 28 of each of the ink containers 18 either before or after they have been filled in the filling station 36.

When another batch is prepared in the tank 34, the same procedure is repeated for the new batch, and the optimal temperature value T obtained for the new batch may be different from that obtained for the former one.

This process assures that the target temperatures stored in the memory chips 28 of the ink containers 18 are precisely adapted to the physical properties of the ink produced in one batch. As a result, a uniformly high print quality can be obtained regardless of slight batch-to-batch-fluctuations in the physical properties of the ink.

The invention being thus described, it will be obvious that the same may be varied in many ways. such variations are not to be regarded as a departure from the spirit and scope of the invention, and all such modifications as would be obvious to one skilled in the art are intended to be included within the scope of the following claims.

What is claimed is:

1. An ink jet printing system comprising a print head containing nozzles, a replaceable ink container, an ink supply system connecting the ink container to the nozzles of the print head, and a temperature control system for controlling the temperature of the ink at which it is supplied to the nozzles, wherein information which permit a determination of the optimal operating temperature for the ink in the ink container is physically encoded on the ink container to be read by the temperature control system, which is adapted to control the said temperature of the ink which is supplied to nozzles using said information.

2. The ink jet printing system according to claim 1, wherein the physical encoding on the ink container is formed by an electronic memory chip adapted to communicate with a reading head.

3. The ink jet printing system according to claim 1, wherein the print head is a multi-color print head having a plurality of the ink supply systems, and the temperature control system is adapted to individually control the temperature of the ink at which it is supplied to the nozzles from each of the ink supply reservoirs.

4. The ink jet printing system according to claim 1, wherein the ink container contains hot-melt ink, and the temperature control system includes a heating element.

5. The ink jet printing system according to claim 1, wherein the temperature control system includes a cooling element.

6. The ink jet printing system according to claim 1, wherein the information encoded on the ink container includes at least one target value (T(0)) for the temperature of the ink.

7. An ink distribution system which comprises at least one ink container for distributing ink to the nozzles of a print head which comprises an ink supply system for connecting the ink container to the nozzles of the print head, and a temperature control system for controlling the temperature of the ink at which it is supplied to the nozzles wherein information permitting a determination of the optimal operating temperature for the ink in the ink container is physically encoded on the ink container to be read by the temperature control system.

8. The system of claim 7, comprising preparing a batch of ink for filling the ink container, separating a sample of ink from the ink to be filled into the ink container, measuring the viscosity of the ink in the sample, determining the optimal operating temperature for the ink on the basis of the measured viscosity and programming the ink container in accordance with the temperature thus determined.

9. An ink jet printing system comprising a print head containing nozzles, a replaceable ink container, an ink supply system connecting the ink container to the nozzles of the print head, and a temperature control system for controlling the temperature of the ink at which it is supplied to the nozzles, wherein information which permits a determination of the optimal operating temperature for the ink is physically encoded on the ink container to be read by the temperature control system, which is adapted to control the said temperature of the ink using said information, said information encoded on the ink container including at least one target value (T(0)) for the temperature of the ink, a filling date of the ink container and parameter $\Delta T/\Delta t$ to indicate the time dependence of the optimal operating temperature of the ink.

10. The ink jet printing system according to claim 9, wherein the parameters T(0) and $\Delta T/\Delta t$ are in the form of a table indicating different operating temperatures for different types of print heads over time.

* * * * *